US007032494B2

(12) United States Patent
Wygant

(10) Patent No.: US 7,032,494 B2
(45) Date of Patent: Apr. 25, 2006

(54) CLAMPABLE BIPOD

(75) Inventor: Steven J. Wygant, Syracuse, IN (US)

(73) Assignee: Blackpoint Engineering, LLC, Goshen, IN (US)

( * ) Notice: Subject to any disclaimer, the term of this patent is extended or adjusted under 35 U.S.C. 154(b) by 0 days.

(21) Appl. No.: 10/788,721

(22) Filed: Feb. 27, 2004

(65) Prior Publication Data

US 2005/0188596 A1 Sep. 1, 2005

(51) Int. Cl.
*F41A 23/10* (2006.01)

(52) U.S. Cl. ..... 89/37.04; 42/94; 248/171; 248/440.1

(58) Field of Classification Search ..... 42/94; 89/1.42, 37.03, 37.04, 40.06; 248/171, 440.1, 248/176.3

See application file for complete search history.

(56) References Cited

U.S. PATENT DOCUMENTS

| | | | | |
|---|---|---|---|---|
| 2,807,904 | A * | 10/1957 | Kreske | 42/94 |
| 3,235,997 | A * | 2/1966 | Stoner | 42/94 |
| 3,235,998 | A * | 2/1966 | Hadley | 42/94 |
| 4,393,614 | A * | 7/1983 | Pickett | 42/94 |
| 4,397,112 | A * | 8/1983 | York | 42/94 |
| 4,449,314 | A * | 5/1984 | Sorensen | 42/94 |
| 4,470,216 | A * | 9/1984 | Harris | 42/85 |
| 4,607,561 | A * | 8/1986 | Frimer | 89/37.04 |
| 4,841,839 | A * | 6/1989 | Stuart | 89/37.04 |
| 5,375,337 | A * | 12/1994 | Butler | 33/506 |
| 5,406,732 | A * | 4/1995 | Peterson | 42/94 |
| 6,289,622 | B1 * | 9/2001 | Desch et al. | 42/94 |

FOREIGN PATENT DOCUMENTS

| | | | |
|---|---|---|---|
| DE | 32 18 765 | A1 * | 12/1983 |
| EP | 0 088 011 | A1 * | 9/1983 |
| JP | 2-118400 | * | 5/1990 |

* cited by examiner

*Primary Examiner*—Stephen M. Johnson
(74) *Attorney, Agent, or Firm*—Taylor & Aust, P.C.

(57) ABSTRACT

A shooting device, including at least one of a barrel, a rail and a stock, and a clampable bipod. The clampable bipod includes a clamp which is releasably clamped to at least one of the barrel, the rail and the stock, and a first leg and a second leg connected to the clamp.

6 Claims, 3 Drawing Sheets

CLAMPABLE BIPOD

BACKGROUND OF THE INVENTION

1. Field of the Invention

The present invention relates to shooting devices, and, more particularly, to bipods used with shooting devices.

2. Description of the Related Art

Bipods are known for use with shooting devices which can be designed specifically for hunting, target practice, war games, etc. These bipods can greatly improve the accuracy of the shooter by providing a stabilizing support for the shooting device. Bipods can be used while the shooter is sitting, kneeling or even standing if there is a raised platform to support the bipod. Bipods can also be used when the shooter is stalking or treestand hunting.

Bipods are known which attach to a threaded sling receiver using a sling stud. However, these bipods require that the sling be removed from the shooting device, at least at the threaded sling receiver, and be replaced with the bipod. While the shooting device is more convenient to shoot, it is less convenient to carry, and activities such as hunting and war games typically require both convenient carrying and shooting. Also, the threaded sling receiver is part of the shooting device stock, and in modern shooting devices the stock is much shorter than the barrel so that the bipod is located midway along the barrel which is not as stable as a bipod located at or near the end of the barrel. This method also restricts the bipod location to a single position along the stock which may not be the best position particularly when hunting in rough terrain. Further, such a bipod may be limited to use with a single shooting device due to differences in threaded sling receivers and associated bipod compatibility.

Another known method is bipod attachment to a sling swivel. This method is slightly more convenient than attaching the bipod to the threaded sling receiver but has the same disadvantages.

A cradle bipod has the advantages of being able to locate the bipod along a variety of positions along the stock or barrel, can easily adapt to a variety of shooting devices and does not require removal of the sling. However, the cradle bipod has the disadvantage of not positively connecting to the shooting device therefor, particularly when following a moving target, cradle bipods can collapse unless held and even when held may not be stable. When stalking, for example, the cradle bipod will need to be carried which is another disadvantage.

Shooting devices can include a rail according to U.S. military standard MIL-STD-1913 which may provide structure for attachment. A bipod suitable for stock attachment will not typically be suited for rail attachment.

What is needed in the art is a bipod which positively connects to a shooting device, which can adapt to any one or all of a barrel, a stock or a rail, which does not require removal of a sling or other disassembly of the shooting device, which can be connected at multiple positions along the shooting device, which provides a stable support for the shooting device, which can be used with a variety of shooting platforms or terrains, which can be used in a variety of shooting positions and which does not need to be separately carried or handled when not in a shooting position.

SUMMARY OF THE INVENTION

The present invention provides a clampable bipod.

The invention comprises, in one form thereof, a shooting device, including at least one of a barrel, a rail and a stock, and a clampable bipod. The clampable bipod includes a clamp which is releasably clamped to at least one of the barrel, the rail and the stock, and a first leg and a second leg connected to the clamp.

An advantage of the present invention is a bipod which positively connects to a shooting device.

Another advantage of the present invention is a bipod which can adapt to any one or all of a barrel, a stock or a rail Yet another advantage of the present invention is a bipod which does not require removal of a sling or other disassembly of the shooting device.

Yet another advantage of the present invention is a bipod which can be connected at multiple positions along the shooting device.

A further advantage of the present invention is a bipod which provides a stable support for the shooting device.

A yet further advantage of the present invention is a bipod which can be used with a variety of shooting platforms or terrains.

An even yet further advantage of the present invention is a bipod which can be used in a variety of shooting positions.

Another advantage of the present invention is a bipod which does not need to be separately carried or handled when not in a shooting position.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
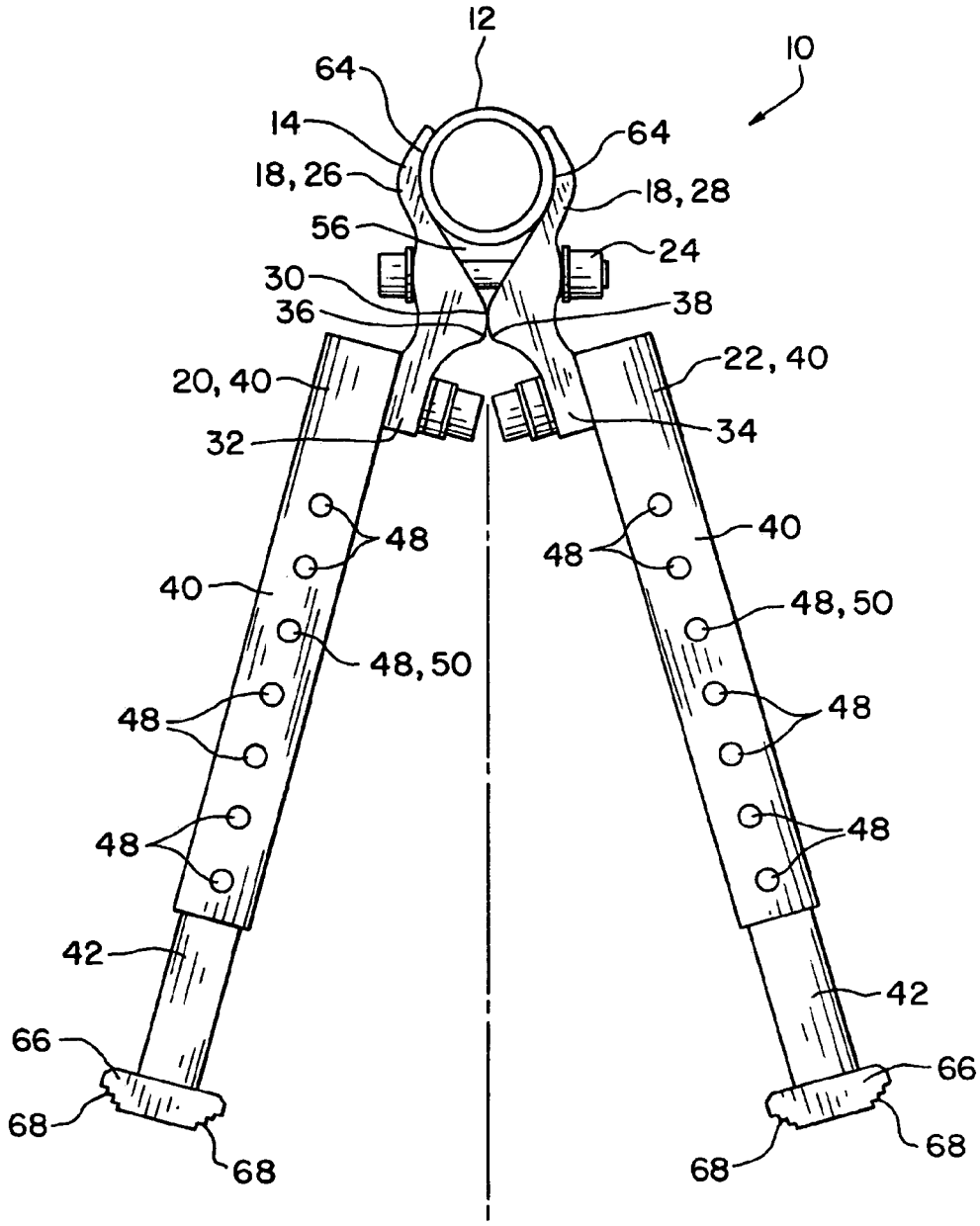
FIG. 1 is a front view illustrating an embodiment of a clampable bipod of the present invention clamped to a barrel of a shooting device.
Figure 2:
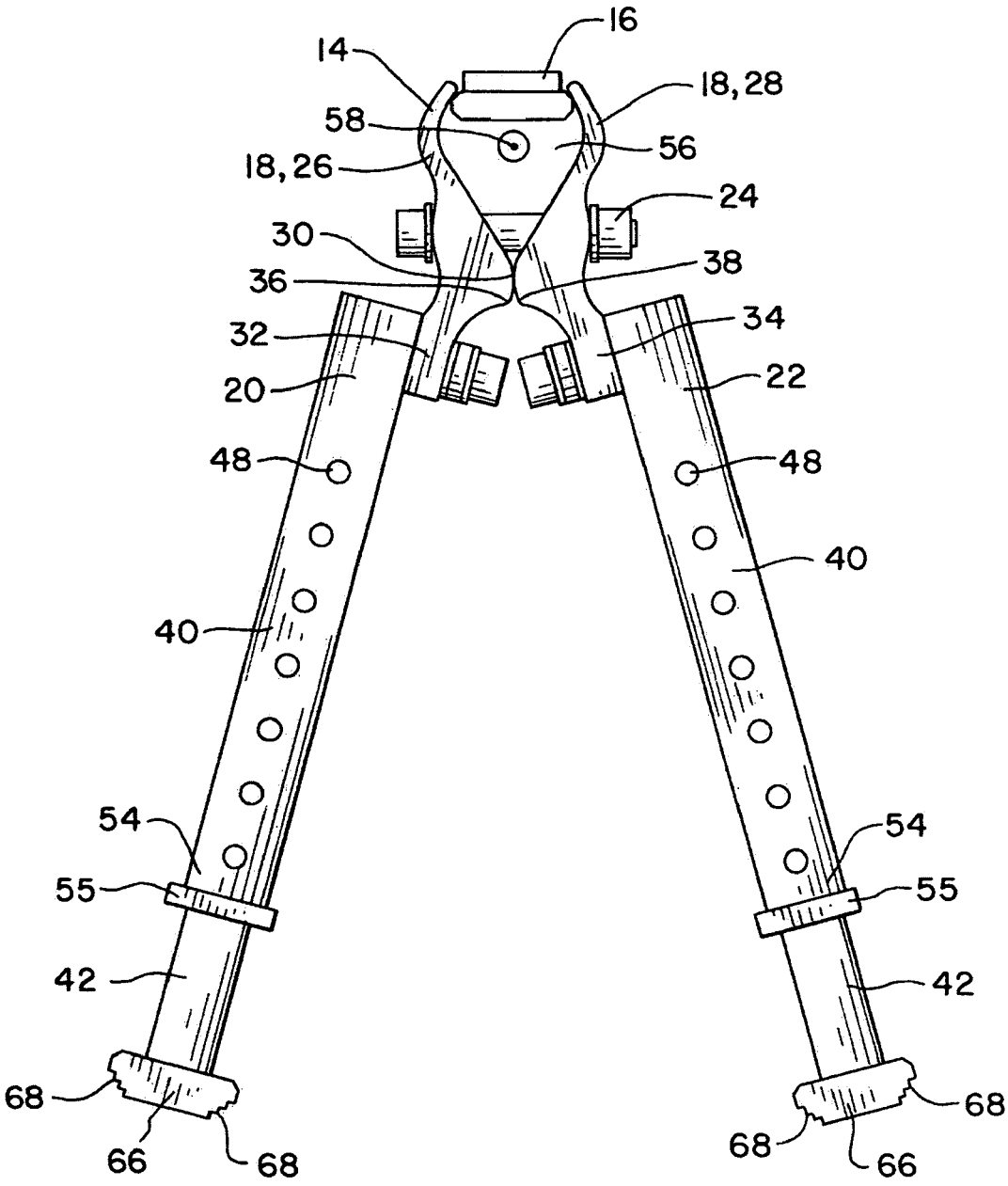
FIG. 2 is a front view illustrating the clampable bipod of FIG. 1 clamped to a rail of a shooting device.
Figure 3:
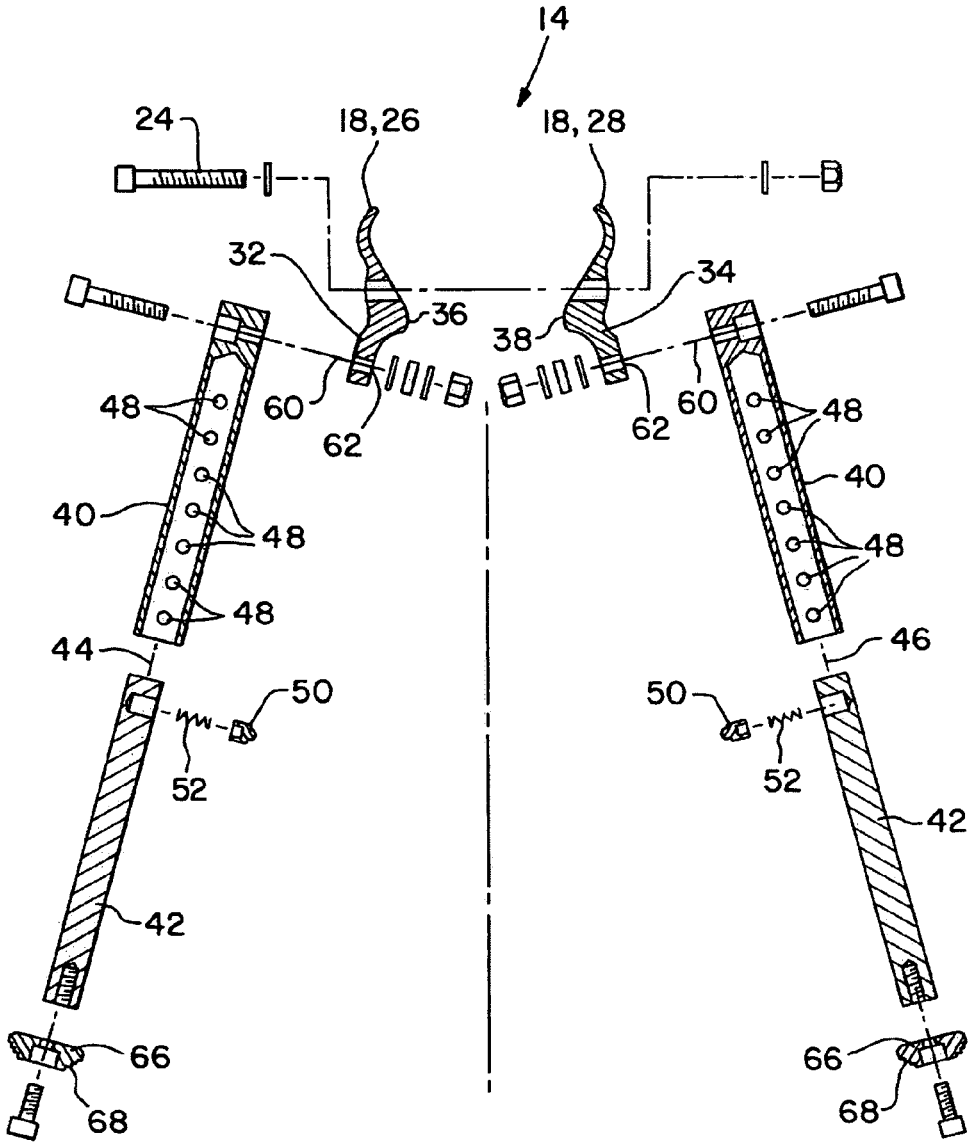
FIG. 3 is an exploded, partially sectional front view of the clampable bipod of FIG. 1.

Referring now to the drawings, and more particularly to FIG. 1, there is shown a shooting device 10 which generally includes a barrel 12 and a clampable bipod 14. Alternatively, clampable bipod 14 can clamp to a rail 16 (FIG. 2) of a shooting device, such as a MIL-STD-1913 rail, or to a stock (not shown) of shooting device 10.

Clampable bipod 14 includes a clamp 18 which is releasably clamped to barrel 12, rail 16 and/or the stock of shooting device 10, and a first leg 20 and a second leg 22 connected to clamp 18.

Clampable bipod 14 includes adjustable compression device 24 connected to clamp 18. Clamp 18 includes a plurality of jaws, such as first jaw 26 and second jaw 28, and a fulcrum 30 between jaws 26, 28 and both legs 20,22. Clamp 18 further includes a first arm 32 connected to first leg 20 and a second arm 34 connected to second leg 22. First arm 32 includes a first cam 36 surface and second arm 34 includes a second cam surface 38. Fulcrum 30 is provided by first cam surface 36 in contact with second cam surface 38.

Each of first leg 20 and second leg 22 include a receiver 40 connected to clamp 18 and an extender 42 connect to a corresponding receiver 40. Each receiver 40 includes a longitudinal direction 44, 46 and a plurality of holes 48 extending in a corresponding longitudinal direction 44, 46. Each extender 42 includes a spring ball 50 received in any of the plurality of holes 48. Each spring ball 50 can be biased by a resilient member 52.

Alternatively, a collet 54 can be connected to at least one of extender 42 and receiver 40, and a collet nut 55 is connected to collet 54 to provide longitudinal adjustment of extender 42 within a corresponding receiver 40.

Clampable bipod 14 includes an aperture 56 in clamp 18. Aperture 56 includes a longitudinal direction 58 (looking through aperture 56), and first leg 20 and/or second leg 22 are rotatable about an a axis transverse 60 to the aperture longitudinal direction.

Clamp 18 includes at least one leg stop 62 limiting a rotation of first leg 20 and/or second leg 22. Leg stop 62 can be in the form of a groove (shown) or at least one pin in arms 32, 34, for example. Clamp 18 can include a cushioning device 64 such as electrical tape, foam, padding, felt, or other relatively soft material and the like. Each extender 42 can include a foot 66 where each foot 66 can include a graduated surface 68 to provide improved purchase of a support surface (not shown).

In use, clampable bipod 14 is connected to a shooting device by positioning clampable bipod 14 adjacent to a barrel 12, a rail 16 and/or a stock of shooting device 10. Clampable bipod 14 is clamped to barrel 12, rail 16 and/or the stock. Clamp 18 is compressed on said at least one of barrel 12, rail 16 and the stock by adjustable compression device 24 connected to clamp 18. First leg 20 and/or second leg 22 can be rotated about an axis transverse 60 to a longitudinal axis 58 of clamp 18. First leg 20 and/or second leg 22 can be extended. First leg 20 and/or second leg 22 can be pivoted about fulcrum 30 of clamp 18 to compress or release clamp 18 from barrel 12, rail 16 and/or the stock.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A shooting device, comprising:

at least one of a barrel, a rail and a stock; and a clampable bipod including a clamp which is releasably clamped to at least one of said barrel, said rail and said stock, and a first leg and a second leg connected to said clamp, said clamp including a plurality of jaws, and a fulcrum between said plurality of jaws and both said first leg and said second leg, said clamp including a first arm connected to said first leg and a second arm connected to said second leg, said first arm including a first cam surface and said second arm including a second cam surface, said fulcrum being provided by said first cam surface in contact with said second cam surface, wherein each of said first leg and said second leg include a receiver connected to said clamp and an extender connect to said receiver, said receiver includes a longitudinal direction and a plurality of holes extending in said longitudinal direction, said extender includes a spring ball received in any of said plurality of holes.

2. A clampable bipod for use with a shooting device, comprising;

a first leg and a second leg, each of said first leg and said second leg including a receiver connected to said clamp and an extender connect to said receiver, said receiver including a longitudinal direction and a plurality of holes extending in said longitudinal direction, said extender including a spring ball received in any of said plurality of holes; and a clamp connected to said first leg and said second leg, said clamp including a plurality of jaws, and a fulcrum between said plurality of jaws and both said first leg and said second leg, said clamp including a first arm connected to said first leg and a second arm connected to said second leg, said first arm including a first cam surface and said second arm including a second cam surface, said fulcrum being provided by said first cam surface in contact with said second cam surface.

3. A clampable bipod for use with a shooting device, comprising:

a first leg and a second leg, each of said first leg and said second leg including a receiver, an extender received within said receiver, a collet connected to at least one of said extender and said receiver, and a collet nut connected to said collet; and a clamp connected to said first leg and said second leg, said clamp including a plurality of jaws, and a fulcrum between said plurality of jaws and both said first leg and said second leg, said clamp including a first arm connected to said first leg and a second arm connected to said second leg, said first arm including a first cam surface and said second arm including a second cam surface, said fulcrum being provided by said first cam surface in contact with said second cam surface.

4. A clampable bipod for use with a shooting device, comprising:

a first leg and a second leg; and a clamp connected to said first leg and said second leg, said clamp including a plurality of jaws, ends fulcrum between said plurality of jaws and both said first leg and said second leg, said clamp including a first arm connected to said first leg and a second arm connected to said second leg, said first arm including a first cam surface and said second arm including a second cam surface, said fulcrum being provided by said first cam surface in contact with said second cam surface, further including an aperture in said clamp, said aperture including a longitudinal direction, at least one of said first leg and said second leg are rotatable about an a axis transverse to said longitudinal direction.

5. The clampable bipod of claim 4, wherein said clamp includes at least one leg stop limiting a rotation of at least one of said first leg and said second leg.

6. A method of attaching a clampable bipod to a shooting device, comprising the steps of:

positioning said clampable bipod adjacent to at least one of a barrel, a rail and a stock of said shooting device;

clamping said clampable bipod to at least one of said barrel, said rail and said stock, said clampable bipod including a clamp connected to both a first leg and a second leg said clamp, said clamp including a plurality of jaws, and a fulcrum between said plurality of jaws and both said first leg and said second leg, said clamp including a first arm connected to said first leg and a second arm connected to said second leg, said first arm including a first cam surface and said second arm including a second cam surface, said fulcrum being provided by said first cam surface in contact with said second cam surface; and rotating at least one of said first leg and said second leg about an axis transverse to a longitudinal axis of said clamp.

* * * * *

UNITED STATES PATENT AND TRADEMARK OFFICE

CERTIFICATE OF CORRECTION

PATENT NO. : 7,032,494 B2
APPLICATION NO. : 10/788721
DATED : April 25, 2006
INVENTOR(S) : Wygant It is certified that error appears in the above-identified patent and that said Letters Patent is hereby corrected as shown below:

COLUMN 4

Line 42, delete “ends”, and substitute therefore --and a--.

Signed and Sealed this

Twenty-sixth Day of December, 2006

JON W. DUDAS
*Director of the United States Patent and Trademark Office*